US005659657A

United States Patent [19]

Overdorf

[11] Patent Number: 5,659,657

[45] Date of Patent: Aug. 19, 1997

[54] PIVOTALLY MOUNTED RADIANT HEATING APPARATUS WITH ADJUSTABLE HEATERS

[75] Inventor: Joel R. Overdorf, Clinton, Mich.

[73] Assignee: Brokaw, Inc., Dexter, Mich.

[21] Appl. No.: 447,539

[22] Filed: May 24, 1995

[51] Int. Cl.[6] ..... F21V 7/00

[52] U.S. Cl. ..... 392/422; 392/424; 392/430; 219/524

[58] Field of Search ..... 392/422, 424, 392/413, 415, 412, 430, 431, 411, 417; 219/524, 541, 537; 362/239, 238, 232, 250, 427, 428, 429, 269, 285, 418, 287

[56] References Cited

U.S. PATENT DOCUMENTS

| | | | |
|---|---|---|---|
| 2,795,683 | 6/1957 | Teiger | 392/430 |
| 2,896,058 | 7/1959 | Perryman | 219/388 |
| 2,917,616 | 12/1959 | Thomson | 392/423 |
| 3,654,430 | 4/1972 | Thayer | 392/422 |
| 4,179,600 | 12/1979 | Haberhauer | 392/417 |
| 4,202,112 | 5/1980 | Eltz et al. | 219/388 |
| 4,538,217 | 8/1985 | Ewing et al. | 362/427 |
| 4,818,849 | 4/1989 | Matlen | 392/411 |
| 5,142,795 | 9/1992 | Abbott | 392/411 |
| 5,155,798 | 10/1992 | Denend | 392/424 |

FOREIGN PATENT DOCUMENTS

| | | | |
|---|---|---|---|
| 257844 | 9/1926 | United Kingdom | 362/427 |
| 285599 | 2/1928 | United Kingdom | 392/430 |
| 291691 | 6/1928 | United Kingdom | 392/422 |
| 9113770 | 9/1991 | WIPO . | |

*Primary Examiner*—Tu B. Hoang
*Attorney, Agent, or Firm*—Young & Basile, P.C.

[57] ABSTRACT

A heater element support frame is pivotally mounted at one edge to a support member attached to a reflector for movement between a first position disposing the frame adjacent to the reflector and a second position in which the frame is spaced from the reflector. Heater element end caps are slidably mounted in slots formed in sidewalls of the frame and mountable in a selectively adjustable position along the slots. Alternately, slots are formed in the reflector and arranged in a dimensional relationship to receive the end cap mounts such that the ends of two adjacent alternating heater elements of two side-by-side arranged columns of heater elements are offset from each other such that the heat generating portion of one heater element overlaps a non-heat generating portion and the end cap of an adjacent heater element.

13 Claims, 5 Drawing Sheets

PIVOTALLY MOUNTED RADIANT HEATING APPARATUS WITH ADJUSTABLE HEATERS

BACKGROUND OF THE INVENTION

1. Field of the Invention

The present invention relates, in general, to heat radiating devices and, more particularly, to mounting apparatus for quartz heater tubes.

2. Description of the Art

Infrared heaters are widely used to apply high intensity heat to various articles to effect drying of the articles and/or coatings applied to the articles. One type of infrared heating device is a quartz infrared heater formed of a resistance wire element mounted within a tube. Typically, the quartz tube includes ceramic end caps through which electrical connections to the resistance wire heating element are made, with the end caps also serving to mount and attach the heater tube in a desired position on a structural support frame.

The end caps are mounted on the frame in a particular configuration to provide a desired heating quantity and heat pattern to the article. Typically, vertical columns of parallel arranged pairs of end caps are fixedly mounted to a frame structure. To enhance the heating efficiency of the quartz heater tubes, a shiny reflector surface is mounted behind the quartz heater tubes and the frame.

While such infrared heating structure has proven effective, it is not without its deficiencies. Since the frame is fixedly mounted to the reflector surface, or the heater tubes are mounted directly on the reflector surface, it is difficult to easily clean and/or repair the reflector surface without removing the quartz heater tubes from the end caps.

Further, as the quartz heater tubes or lamps are designed in a specific arrangement to provide a desired heat quantity in a specific pattern to an article, subsequent modifications to the article or the use of the heater assembly with different products requires a rearrangement of the lamps, such as the use of additional or fewer lamps or a rearrangement of the position of lamps in the frame. Since the end caps are fixedly mounted on the frame and/or on the reflector surface, rearrangement and/or changing the number of the lamps is time consuming and costly.

Another deficiency encountered with the typical prior art side-by-side, vertical column arrangement of heater lamps is due to the side-by-side mounting of the end caps in each column. Since the last ¾" to 1" of each lamp is a non-heat generating surface, this short distance coupled with the length of the end cap itself creates a significant non-heat generating space between two end to end arranged lamps in adjacent vertical columns. This leads to gaps in the heating pattern and less than maximum heating efficiency.

Thus, it would be desirable to provide a heater element mounting apparatus including lamps mounted on a frame structure, which structure is movable relative to a rear disposed reflector surface. It would also be desirable to provide a heater element mounting apparatus in which the lamp end caps are selectively adjustable in position within the frame structure of the apparatus. It would also be desirable to provide such a heater lamp mounting apparatus in which the end caps are fixedly lockable in variably selectible positions within the frame structure. It would also be desirable to provide a heater lamp mounting apparatus which minimizes the effects of the non-heat generating ends of the lamps and the end caps over the height and width of the mounting apparatus.

SUMMARY OF THE INVENTION

The present invention is a heater lamp mounting apparatus which provides significant advantages over previously devised heater lamp mounting apparatus.

In one embodiment, the apparatus includes a frame having open front and back surfaces. A plurality of heat generating elements, such as infrared lamps, are mounted in the frame. A reflector surface is disposed adjacent the back opening of the frame. Means are provided for pivotally mounting the frame to the reflector surface to permit pivotal movement of the frame between a first position in which the frame is disposed adjacent to the reflector surface and a second position in which the frame is spaced from the reflector surface. Preferably, the mounting means is in the form of a support member attached to the reflector surface. Hinge means is connected to the support member and the frame. Means are also provided for releasibly locking the frame in the first position to the reflector surface.

In another embodiment, the heater element mounting apparatus includes slots formed in the sidewalls of the frame or in the reflector surface. An end cap releasibly receives each end of the heat element or lamp. Means are provided for releasibly mounting each end cap in a selected position along the length of each slot. Alternately, a hollow housing carries each end cap, with the housing having opposed mounting flanges. Fasteners extendible through the mounting flanges engage a mounting member disposed on an opposite side of the frame or reflector surface to slidably position the housing and the end cap mounted therein in a selected position along the length of the slot.

In another embodiment, means are provided for mounting the end caps in a staggered offset array such that the heat generating portions of alternatingly spaced heater element overlap the non-heat generating portions of interposed, adjacent heater elements to form a substantially continuous heat generating surface. Two adjacent slots in the reflector surface are spaced apart by a predetermined distance, with one slot receiving one end cap and mounting housing, with the heater element extending in a first direction therefrom, and the adjacent slot receiving the end cap and mounting housing of an adjacent heater element, with the adjacent heater element extending therefrom in a second direction opposite from the first heater element.

The heater element mounting apparatus of the present invention provides significant advantages over previously devised heater element mounting arrangements. By pivotally mounting the frame supporting a plurality of heat generating elements or lamps with respect to a rear reflector surface, the frame may be pivoted away from the reflector surface to provide easy access to the reflector surface for cleaning or repair of the reflector surface. Further, the end caps receiving the heater elements are slidably mounted within the frame to permit repositioning of the heater elements as needed to change the heating pattern generated by the apparatus. Further, the end caps of adjacent disposed heater elements may be offset from each other in two spaced slots formed in the reflector surface such that the heat generating portions of alternatingly spaced elements overlap the non-heat generating ends and end caps of adjacent interposed elements to provide a substantially continuous heat generating surface over the entire vertical and horizontal extent of the heater apparatus.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
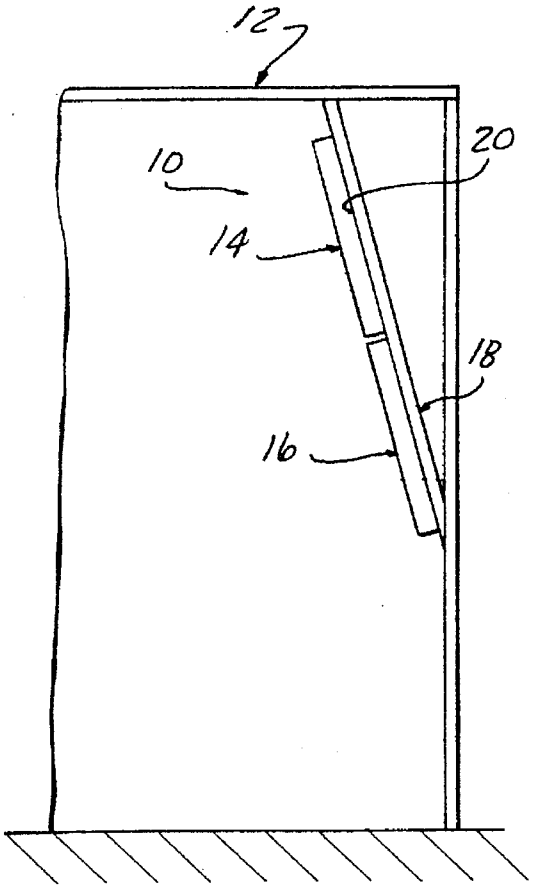
FIG-1 PRIOR ART
FIG. 1 is an end view of a conventional infrared heater oven.

Referring now to the drawing, and to FIG. 1 in particular, a heater element mounting apparatus 10 for applying heat to an article is depicted. The mounting apparatus 10 is typically employed in an oven 12 through which articles pass, typically by means of a conveyor, not shown. The mounting apparatus 10 includes one or more frame assemblies, with two frame assemblies 14 and 16 being depicted in FIG. 1 by way of example only. Each frame assembly 14 and 16 is mounted, in the present example, to a reflector frame 18 having a shiny reflector surface mounted or formed on one side, adjacent the rear surface of the frames 14 and 16.

By way of example only, the reflector surface shown generally by reference number 20 is formed of stainless steel; although other materials and/or shiny, reflectorized coatings may also be employed on any suitable backing or substrate.

Figure 2:
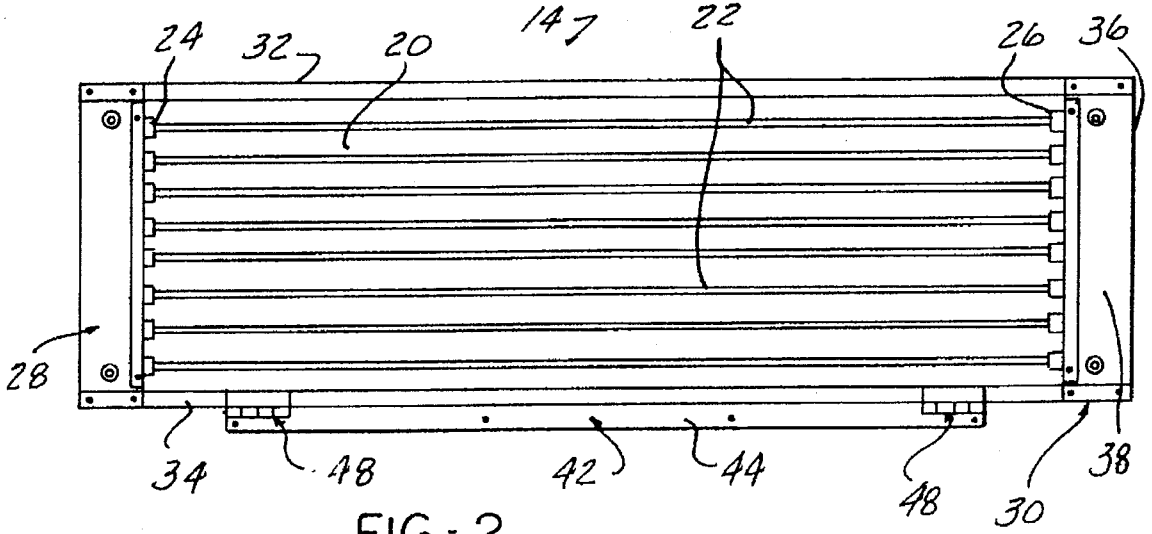
FIG. 2 is a front view of a heater element mounting assembly constructed in accordance with one embodiment of the present invention.

As shown in FIGS. 2–5, the frame 14 is designed to mount a plurality of heater elements 22 in a desired pattern or arrangement. Typically, the heater elements 22 are mounted in a vertical column as shown in FIG. 2.

As is conventional, each heater element 22 has an elongated, generally cylindrical tubular shape and is formed of a suitable refractory material, such as quartz glass. Each tube 22 may be formed with either a clear, opaque or frosted sidewall. The opposed ends of each tube 22 are removably mounted in end caps or sockets 24 and 26. The end caps 24 and 26, which are identical in form, have a hollow through bore, as described hereafter, for passage of electrical conductors to an electrical resistance wire element contained within the heater tube 22. As described hereafter and shown in FIGS. 6 and 7, each end cap 24 and 26 is also provided with a suitable mounting surface for attachment to mounting surfaces on the frame 14.

The frame 14 includes two side walls or elements 28 and 30. Each side element 28 and 30 is formed of first and second U-shaped channels with the side legs of the first and second channels overlapped to form a hollow generally square or rectangular enclosure. Top and bottom rails 32 and 34 are connected to the side elements 28 and 30 by means of suitable fasteners to form a rigid support structure as shown in FIG. 2. The top and bottom rails 32 and 34, respectively, may also have a U-shaped channular cross section.

Each side element, such as side element 30 includes a central end wall 36 from which extend spaced, generally perpendicular side walls 38. An elongated slot 40 is formed in the central end wall 36 of each side element 28 and 30, the purpose of which will be described in greater detail hereafter.

Figure 3:
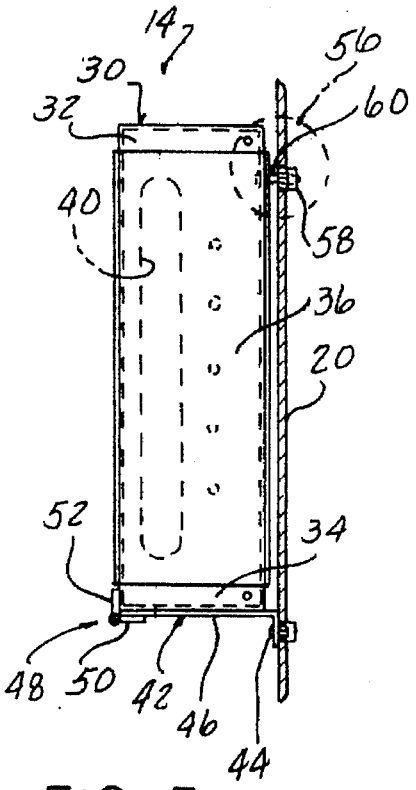
FIG. 3 is an end view of the apparatus in FIG. 2, depicted in a normal use position.

According to a unique feature of a first embodiment of the present invention, the frame 14 is provided with a fold-down capability to enable the frame 14 to be moved or pivoted away from the reflector 20 for ease of cleaning or repairing the reflector surface 20. Accordingly, a support member 42 having first and second generally perpendicular arranged legs 44 and 46 is located beneath the bottom rail 34 of the frame 14. The first leg 44 is secured to the reflector 20 or the frame in which the reflector 20 is mounted by means of suitable fasteners. The second leg 46 of the support member 42 underlies and is disposed in registry with the bottom rail 34 as shown in FIG. 3. A pivot means denoted generally by reference number 48 pivotally interconnects the support member 42 and the frame 14. The pivot means 48 may take the form of any conventional hinge, such as a single elongated continuous hinge or a plurality of spaced hinges, such as two hinges 48 shown in FIG. 2. By way of example only, the pivot means or hinge 48 is in the form of a leaf-type hinge formed of first and second leafs 50 and 52 having intermeshing loops which are interconnected by a pivot pin. The first leaf 50 is securely connected by means of suitable fasteners to the second leg 46 of the support member 42. The second leaf 52 is likewise securely connected to the bottom rail 34 by means of suitable fasteners.

Figure 4:
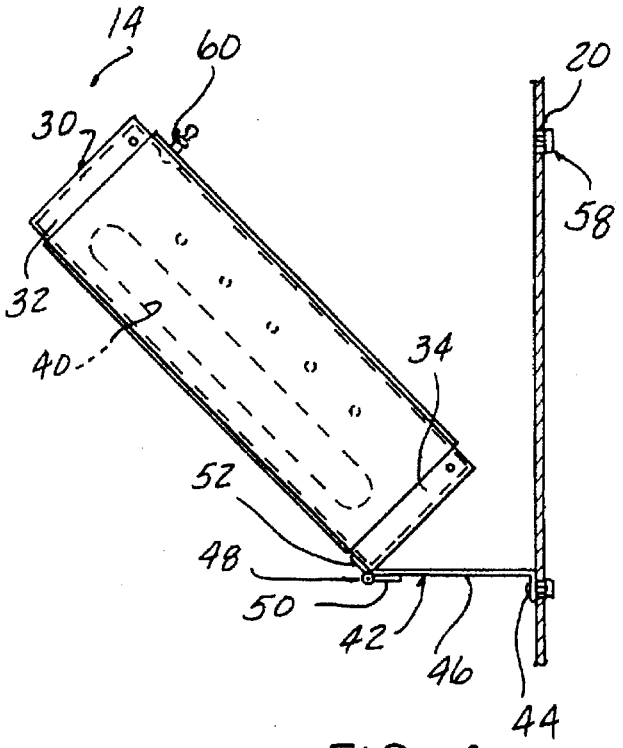
FIG. 4 is a side view, similar to FIG. 3, but showing the apparatus in a fold-down position spaced from the reflector surface.

As shown in FIGS. 3 and 4, the support member 42 and the pivot means or hinge 48 is disposed beneath the bottom rail 34 of the frame 14, with the hinge 48 connected at a front edge of the bottom rail 34 of the frame 14. However, it will be understood that a suitably formed support member and hinge 48 may also be connected to either of the side elements 28 and 30 for horizontal pivotal movement of the frame 14 with respect to the reflector surface 20. Likewise, a suitably formed support member and hinge 48 may be connected to the top rail 32, although this mounting arrangement is not as ideal as the bottom pivot mounting arrangement shown in FIGS. 3 and 4.

Figure 5:
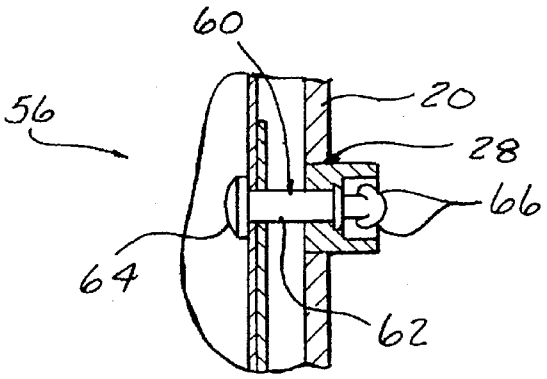
FIG. 5 is an enlarged, cross sectional view of the circled area in FIG. 3.

Releasable mounting means shown in FIGS. 3–5 is provided for releasibly locking the frame 14 in a first, normal use position shown in FIG. 3 in which the frame 14 is securely connected to the reflector 20 or to the reflector frame supporting the reflector 20. Although any suitable releasable fastener 56 may be employed in the present invention, by way of example, the releasable mounting means 56 is in the form of a 90° turn fastener, such as one sold by Southco, part number 82-35-308-55. As shown in FIGS. 3–5, this fastener 56 includes a receptacle 58 which is press fit in an aperture formed in the reflector 20. The receptacle 58 is hollow and includes a pair of spaced 90° locking stops, not shown, within the interior of a bore extending through the receptacle 58.

A pin 60 is formed with a shaft 62 and an enlarged end cap 64 at one end. The shaft 62 extends through an aperture formed in a side wall of one of the U-shaped members forming each side element 28 and 30 as shown in FIGS. 3 and 5. The opposite end of the shaft 62 of the pin 60 is formed with a pair of outwardly extending tabs 66 which engage the locking stops when rotated to one position and disengage from the stops allowing removal of the pin 60 from the receptacle 58 when rotated 90° in an opposite direction.

Starting from a normal use or heat generating position for the frame 14 and the lamps 22 mounted therein, as shown in FIG. 3, the pin 60 are oriented such that the flanges 66 engage the stops in the receptacle 58 to securely attach the upper end of the frame 14 to the reflector 20.

When it is desired to pivot or move the frame 14 away from the reflector 20, as shown in FIG. 4, the pin 60 is rotated 90° from a lock position in FIG. 3 to disengage the flanges 66 from the locking stops within the receptacle 58. This enables the pin 60 to be pulled out of the receptacle 58 and allows the frame 14 to pivot about a lower front edge at the hinge 48 away from the reflector 20. To reposition the frame 14 for heating, the frame 14 is pivoted about the hinge 48 toward the reflector 20 until the pin 60 engages the bore in the receptacle 58. The pin 60 is then rotated 90° to bring the flanges 66 into engagement with the locking stops within the receptacle 58 to again securely affix the frame 14 to the reflector 20 as shown in FIG. 3.

Figure 6:
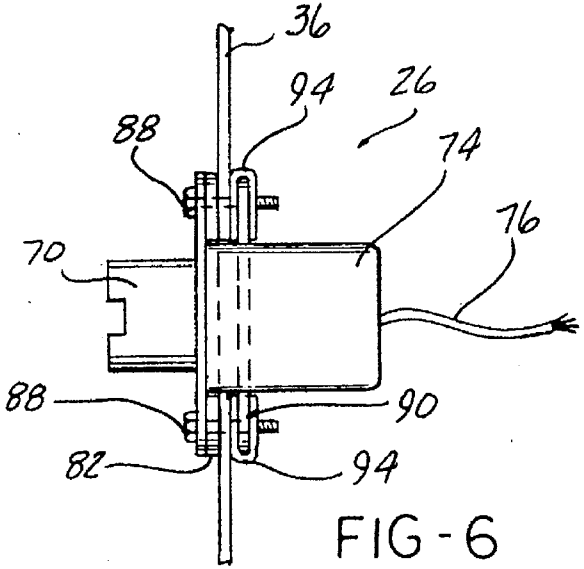
FIG. 6 is a side elevational view of an adjustable heater element mounting arrangement according to another embodiment of the present invention.
Figure 7:
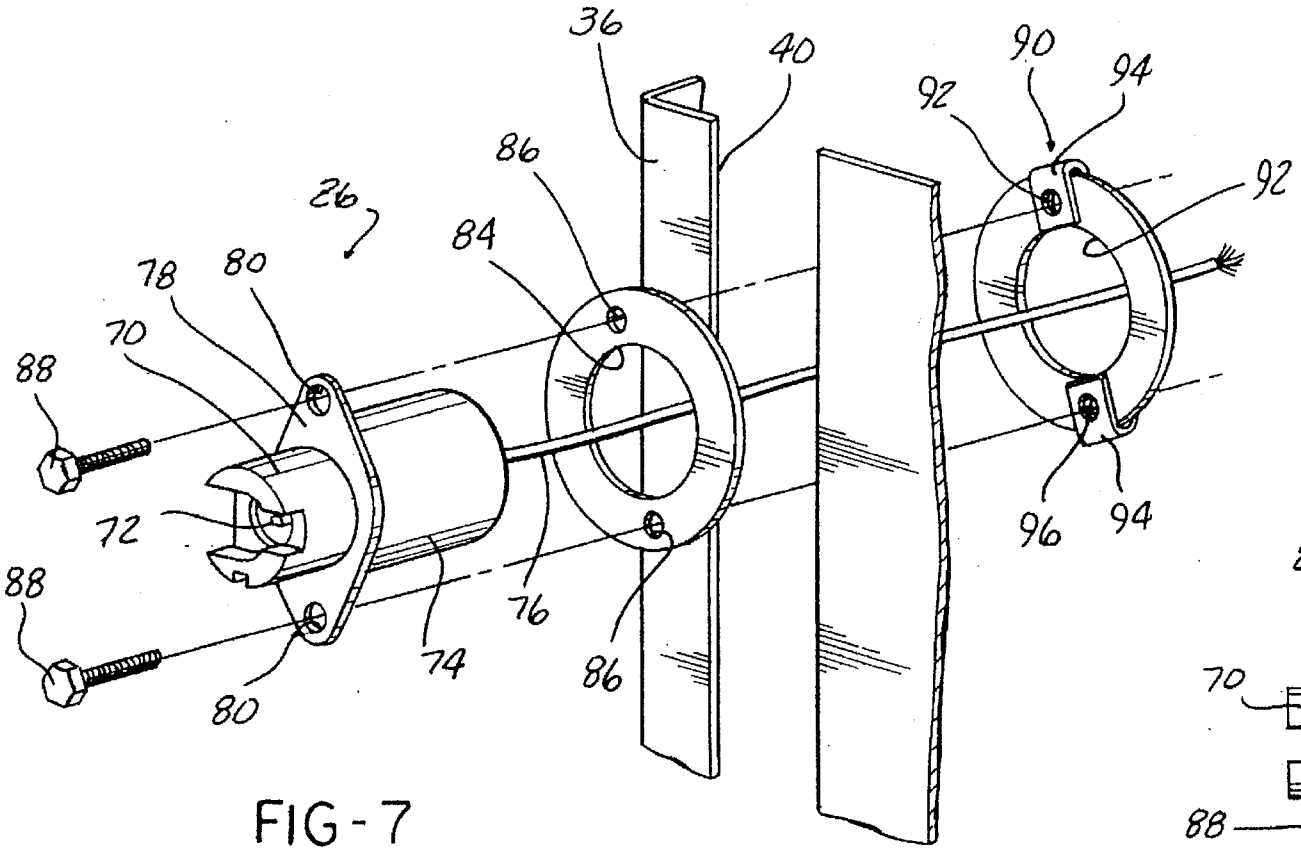
FIG. 7 is an exploded, perspective view showing the adjustable mounting arrangement depicted in FIG. 6.

The frame 14 is also uniquely provided with means for adjustably positioning the end caps 24 and 26 as shown in detail in FIGS. 6 and 7. As described above, the central end wall 36 of each side element 28 and 30 has an elongated slot 40 formed therein.

Each end cap, such as end cap 26 shown in FIGS. 6 and 7, is formed with a first connector end 70 which includes an electrical connector for electrical connection to the resistance element leads formed at opposite ends of the heater tube 22. The connector end 70 is also provided with opposed engagement surfaces for securely supporting one end of a heater tube 22. The end cap 26 is also formed with a hollow housing 74 through which an electrical conductor 76 extends for connection to control equipment to provide electrical power to the resistance element in the heater tube 22. An enlarged mounting flange 78 is formed intermediate the connector end 70 and the housing 74. Opposed mounting apertures 80 are formed in the flange 78.

A first mounting member or washer 82, which is optional but preferred for structural rigidity, is formed with a central aperture 84 sized to receive the housing 74 of the end cap 26. The first washer 82 is disposed adjacent one surface of the central end wall 36 of one of the side elements 28 or 30 of the frame 14. A pair of mounting apertures 86 are formed in the washer 82 to receive fasteners 88 extendible through aligned apertures 80 in the mounting flange 78 of the socket 26 and the apertures 86 in the first washer 82, as well as through the slot 40 in the central end wall 36.

A second mounting member 90, also preferably in the firm of a washer, is located on the opposite side of the central end wall 36 and likewise has a central aperture 90 sized to slidingly receive the housing 74 of the socket 26 therethrough. The second washer 90 has two clips 94 fixedly mounted generally 180° apart on the periphery thereof. The clips 94 have a generally U-shape formed of two spaced legs which are disposed in registry with opposite sides of the washer 90. Each leg has an aperture 96 formed therein which is alignable with a corresponding aperture formed in the washer 90.

In use, the washers 82 and 90 are positioned on opposite sides of the central end wall 36 of the frame 14, with the apertures 84 and 92, respectively, aligned to slidingly receive the housing portion 74 of the socket 26 therethrough. The fasteners 88 are then threaded through the apertures 80 in the mounting flange 78 of the socket 26, the apertures 86 in the first washer 82 and the apertures 96 in the clips 94 mounted on the second washer 90. Until the fasteners are securely tightened down, the entire mounting assembly may be slidingly adjusted to any desired position along the slot 40 in the central end wall 36. When the mounting assembly is in the desired position, the fasteners 88 are tightened down to securely mount the end cap 26 on the end wall 36. This arrangement uniquely enables the mounting position of each heater tube 22 in the frame 14 to be slidingly adjustable to any desired position.

Figure 8:
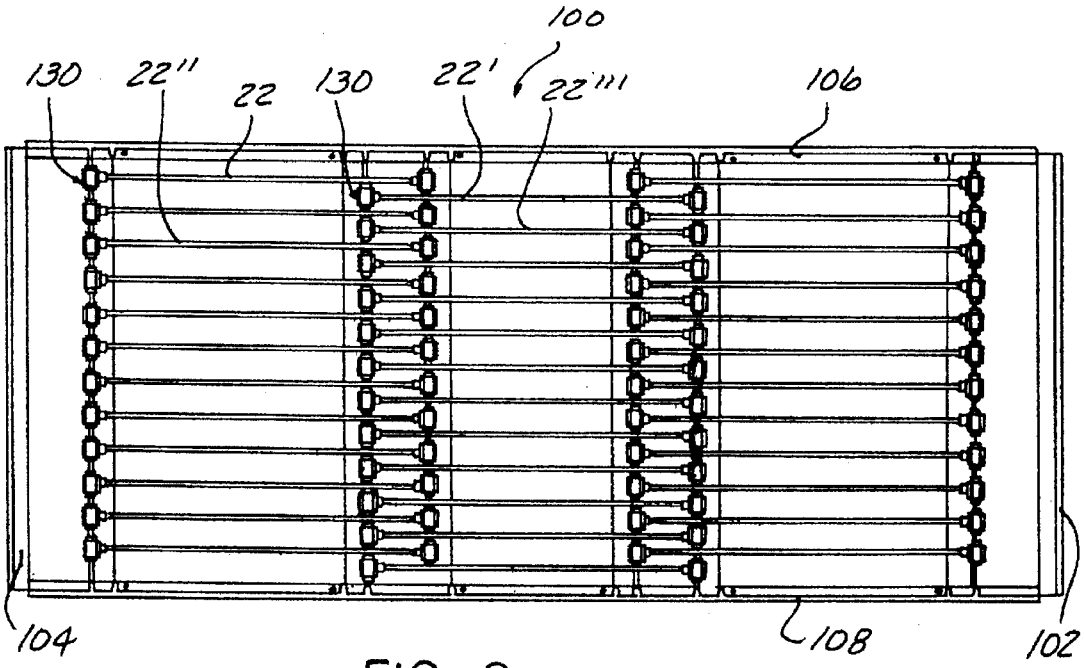
FIG. 8 is a front view of a heater element mounting apparatus with staggered lamp mounts constructed in accordance with another embodiment of the present invention.
Figure 9:
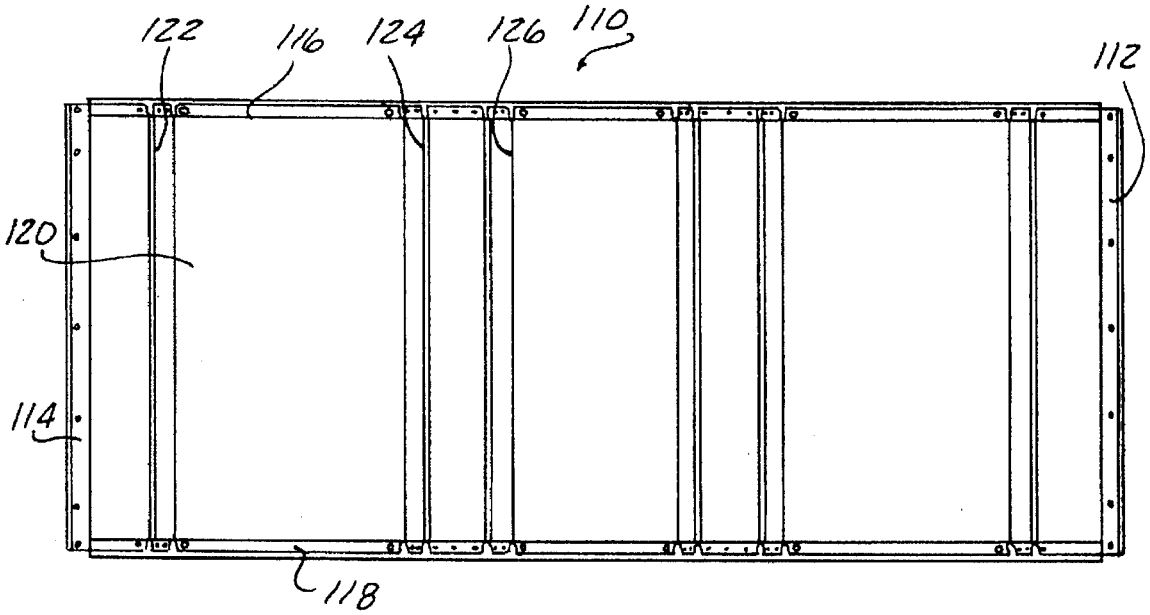
FIG. 9 is a front view of a slotted reflector panel and reflector frame used in the mounting apparatus shown in FIG. 8.

Another embodiment of the present invention is shown in FIGS. 8–12. In this embodiment, a frame 100 supporting a plurality of heater tubes 22, 22', etc, is provided with means for horizontally staggering the ends of vertical and horizontally arranged tubes 22 to provide a continuous vertical and horizontal heat application surface over the entire extent of the frame 100. As shown in FIG. 8, the frame structure 100 includes a main frame assembly formed of interconnected side rails 102 and 104, a top rail 106 and a bottom rail 108. The main frame assembly is fixedly connected to a subframe 110, shown in FIG. 9, which is mounted behind the main frame assembly. The subframe 100 also includes opposed side elements 112 and 114 which are interconnected between a top rail 116 and a bottom rail 118. A reflector surface denoted generally by reference number 120 is secured to the subframe 110. The reflector surface 120 may be formed of one single large sheet or a plurality of coplanar arranged, edge abutted smaller panels or sheets.

Figure 11:
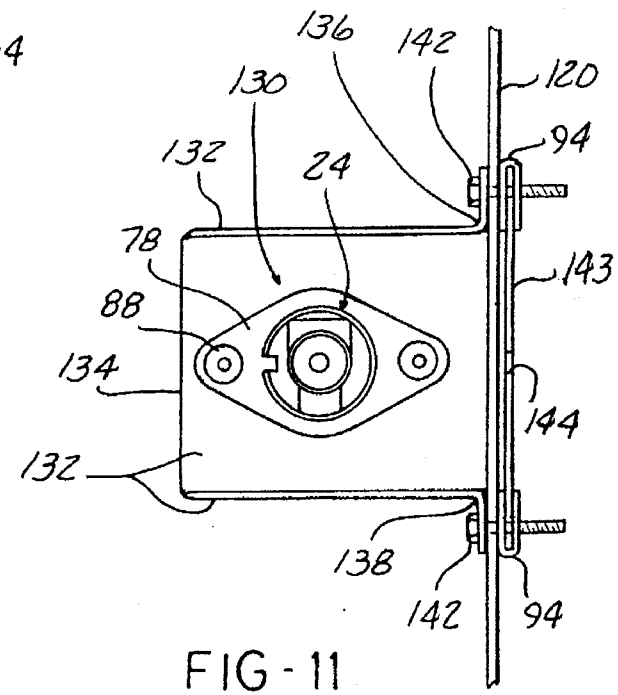
FIG. 11 is a side elevational, assembled view of the lamp mounting arrangement shown in FIG. 10.
Figure 10:
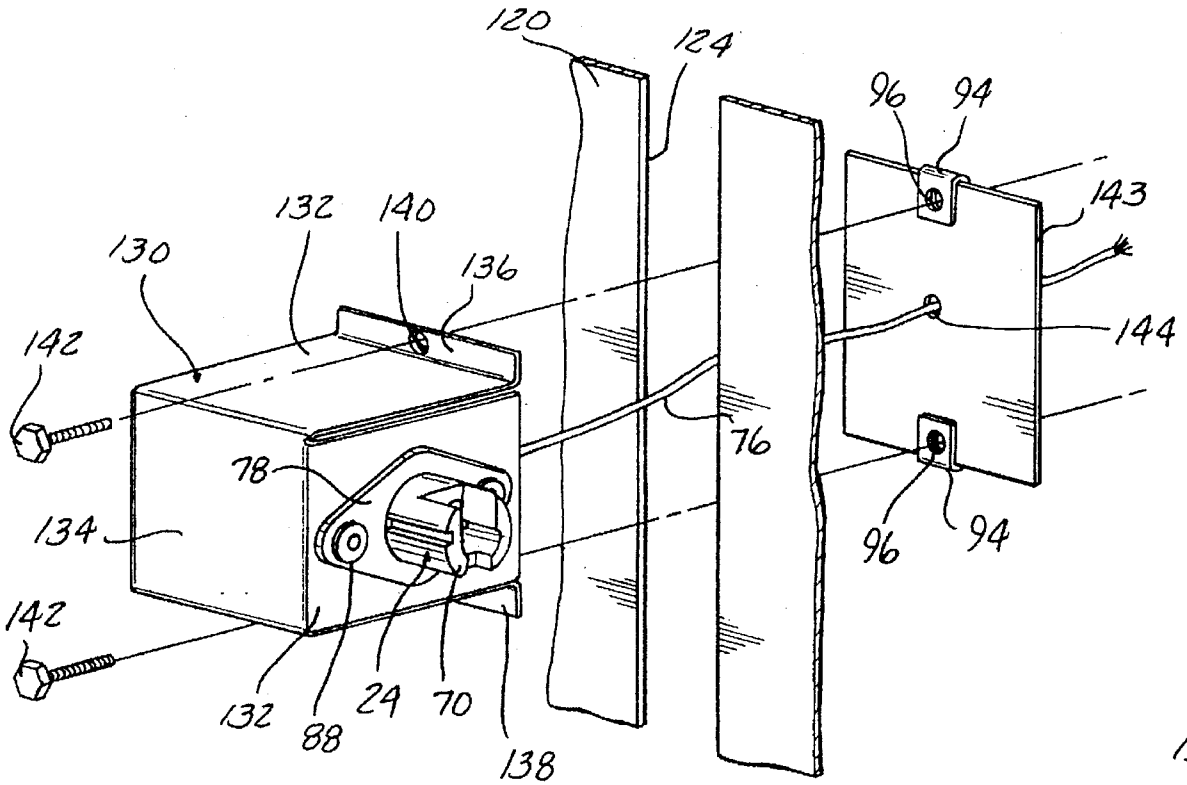
FIG. 10 is an exploded, perspective view of an adjustable heater element mounting arrangement used in the mounting apparatus shown in FIG. 8.

Each end cap 24 and 26, such as end cap 24 shown in FIGS. 10 and 11, is mounted in a hollow housing 130. The housing 130 may have any shape, with the generally cubical shape shown in FIGS. 10 and 11 being by way of example only. Further, by example only, the housing 130 is formed of a single metallic piece which is bent into the illustrated cubical shape by appropriate bending to form four side walls, each denoted by reference number 132, and an outer wall 134. An opening is formed in the housing 130 opposite the outer end wall 134. The mounting flange 78 of the end cap 24 is attached by means of suitable fasteners 88 to one of the sidewalls 132 of the housing 130, with the connector portion 70 extending outward from the housing 130. The housing 130 is also formed with spaced mounting flanges 136 and 138, each of which has an aperture 140 formed therein. The apertures 140 receive fasteners, such as bolts 142, therethrough.

Each housing 130 is disposed adjacent one side or surface of the reflector 120 as shown in FIGS. 10 and 11. A mounting member, such as a washer denoted generally by reference number 143, is disposed adjacent the opposite surface of the reflector 120. The washer 143 may have any shape, such as circular, etc., with the illustrated square shape being by way of example only. An aperture 144 is formed in the washer 143 for receiving the electrical conductors 76 extending from the end cap 24 mounted in the housing 130.

A pair of generally U-shaped clips 94, identical to the clips 94 described above and shown in FIGS. 6 and 7, are mounted on opposite side edges of the washer 143. Each clip 94 includes an aperture 96 alignable with the apertures 140 in the mounting flanges 136 and 138 of the housing 130. Further, the apertures 96 and the clips 94 receive the fasteners 142 to securely interconnect the housing 130 and the washer 143. Prior to tightening of the fasteners 142, the loosely interconnected housing 130 and washer 142 may be slidingly adjusted along the length of the slot 124 in the reflector 120 to any desired position. The fasteners 142 are then tightened to securely position the housing 130 and the end cap 24 mounted therein in the desired position on the reflector 120. Alternately, the housings 130 could be fixedly and non-movably attached to the reflector surface 120.

Figure 12:
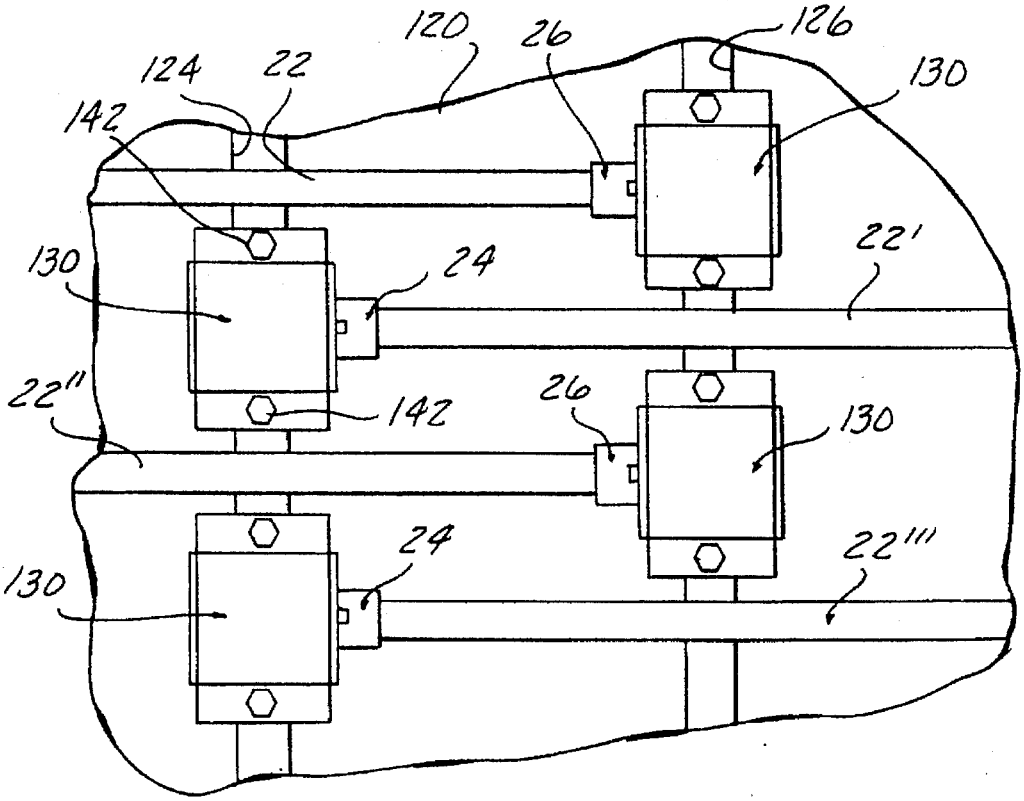
FIG. 12 is an enlarged, partial view of the staggered arrangement of the ends of vertically spaced heater elements shown generally in FIG. 8.

Referring now to FIG. 12, the staggered arrangement of the end caps 24 and 26 of four vertically spaced tubes, such as heater tubes 22, 22', 22" and 22'", is depicted. The heater tubes are arranged in two sets of columns, with the columns disposed side-by-side. A pair of slots are formed in the reflector 120 to receive the mounting attachments for the end caps employed in each column of parallel heater tubes. The spacing between adjacent slots 124 and 126 on the reflector 120 offsets the end caps 24 and 26 of two vertically adjacent heater tubes, such as heater tubes 22 and 22'. This staggers or offsets the non-heat generating end of each heater tube which extends for approximately ¾" to 1" at each end of each heater tube 22 and the end cap 24 or 26 and the associated housing 130 from adjacent interposed heater tubes.

As clearly shown in FIG. 12, in a vertical array of spaced, parallel heater tubes 22, 22', 22" and 22'", the heat generating portion of heater tubes 22 and 22" vertically overlays the non-heat generating end portion of heater tubes 22' and 22'" and the associated end caps 24 and mounting housings 130. Similarly, the heat generating portions of heater tubes 22' and 22'" overlays the ends of heater tubes 22 and 22" and the respective end caps 26 and housings 130 thereof. This arrangement uniquely provides a substantially continuous heat generating surface over the entire vertical and horizontal extent of the frame assembly thereby providing a more even heating of articles adjacent to the frame.

In summary, there has been disclosed a unique mounting frame apparatus for heater elements which provides significant advantages over previous heater element mounting apparatus. The mounting apparatus of the present invention provides unique pivotal or fold down capability which enables the heater elements and the surrounding frame structure to be disconnected from and pivoted away from the rear reflector surface to enable easy access to the reflector surface for cleaning, repair, etc. The frame assembly is also provided with a unique slidable mounting arrangement for the end caps of the heater elements which enables easy and quick repositioning of the heater elements within the frame structure for different shaped articles, different heating patterns, etc. Finally, the frame apparatus provides for a staggered offset end mounting of vertically adjacent heater elements to accommodate the non-heat generating end portions of the heater elements and the end caps connected thereto. This enables a more even, continuous heating surface to be provided over the entire vertical and horizontal extent of the frame.

What is claimed is:

1. A heater element mounting apparatus comprising:

a frame having front and back openings;

a heater element mounted in the frame and having opposed ends;

a reflector surface disposed adjacent the back opening of the frame;

means for pivotally mounting the frame to the reflector surface permitting movement of the frame from a first position in which the back opening of the frame is adjacent the reflector surface and a second position in which the back opening is spaced from the reflector surface;

means for releasibly locking the frame in the first position to the reflector surface, the locking means including:

fastener means mounted on the frame; and fastener receiver means, mounted on the reflector surface, for releasibly receiving the fastener means an elongated, uninterrupted slot formed in each side wall of the frame;

an end cap connected to each opposed end of the heater element; and means for slidably mounting each end cap in a side wall to permit slidable adjustment of each end cap along the slot in each side wall, the mounting means including:

a mounting flange carried on each end cap;

a first mounting member mountable adjacent one surface of a side wall of the frame, opposite from a surface engaged by the mounting flange of the end cap; and apertures formed on the first mounting member and the mounting flange; and fastener means extendible through the apertures in the mounting flange and the first mounting member, and extending through the slot, for interconnecting the end cap to the first mounting member at a selectively adjustable position along the side wall.

2. The apparatus of claim 1 wherein the mounting means comprises:

a support member attached to the reflector surface; and hinge means for pivotally connecting the support member and the frame.

3. The apparatus of claim 1 further comprising:

a second mounting member interposed between the mounting flange of the end cap and an adjacent surface of the side wall of the frame.

4. The apparatus of claim 1 wherein:

the hinge means pivotally connects the bottom wall of the frame to the support member.

5. The apparatus of claim 1 wherein the support member comprises:

a first leg attached to the reflector surface and an opposed second leg; and the hinge means is connected between the bottom wall of the frame and the second leg of the support member.

6. The apparatus of claim 1 wherein the heater element comprises:

at least one infrared lamp.

7. A heater element mounting apparatus comprising:

a reflector;

at least one heat generating element having opposed ends;

an end cap releasibly receiving each end of the heat generating element;

a frame having opposed side walls;

one elongated, uninterrupted slot formed in each side wall, the slots being co-planarly aligned; and means, acting through each slot, for adjustably mounting each end cap in a slidable position in each slot in each side wall with respect to the reflector surface, the mounting means including:

a first mounting member disposed adjacent one surface of a side wall of the frame;

an enlarged collar carried on each end cap;

apertures formed in the first mounting member and the collar; and fastener means, extendible through the apertures in the collar on the end cap and the first mounting member, and extending through the slot, for interconnecting the collar and the first mounting member in a selectively adjustable position in the side wall.

8. The apparatus of claim 7 further comprising:

a second mounting member disposed adjacent an opposite surface of one of the side walls and disposed between the opposite surface and the enlarged collar, the second mounting member receiving the fastener means therethrough.

9. A heat apparatus comprising:

a reflector;

at least one heat generating element having opposed ends;

an end cap releasibly receiving each end of the one heat generating element;

a pair of spaced, elongated, uninterrupted slots formed in the reflector; and means for adjustably mounting each end cap in a selectable position in each slot, the mounting means including:

a pair of hollow housings, each having first and second opposed mounting flanges, an aperture formed in each mounting flange, one end cap mounted in the housing for disposing the heat reflector element parallel to a plane formed by the first and second mounting flanges;

a first mounting member having a pair of apertures alignable with the apertures in the first and second mounting flanges of the housing, the first mounting member disposed on one side of the reflector opposite from the housing and fastener means, extendible through the apertures in the first and second mounting flanges of each housing and the mounting member, for interconnecting the housing and reflector.

10. The apparatus of claim 9 further comprising:

a plurality of heater elements disposed in two side-by-side columns;

a pair of slots formed in the reflector for each column of heater elements and;

means for offsetting the end caps of alternating heater elements in the two columns of heater elements such that a heat generating portion of one heater element in one of the two columns overlaps a non-heat generating portion and the end cap of an adjacent heater element in the other of the two columns of heater elements.

11. The apparatus of claim 10 wherein the offsetting means comprises:

one slot of one of the pair of slots of one column of heater elements spaced adjacent to at least one slot of the other pair of slots and between the slots of the other pair of slots; and the mounting means for a first set of heater elements disposed in the one pair of slots and the mounting means for a second set of heater elements disposed in the other pair of slots with the end portions of heater elements in the two columns of heater elements alternately along the pairs of slots.

12. An heater apparatus comprising:

a reflector surface;

a plurality of elongated, uninterrupted slots formed in the reflector surface;

a plurality of heater elements disposed in first and second sets of column arranged heater elements, a portion of each heater element of the second set of heater elements alternatingly disposed between two heater elements of the first set of heater elements;

an end cap connected to each opposed end of each heater element;

means, acting through the slots, for adjustably mounting each end cap to the reflector surface such that a heat generating portion of each heater element in the first set of heater elements is disposed adjacent to an end cap and a non-heat generating portion of an adjacent heater element of the second set of heater elements.

13. The heater apparatus of claim 12 further comprising:

the plurality of slots including a pair of slots formed in the reflector surface for each column of heater elements;

one slot of one of the pair of slots of one column of heater elements spaced adjacent to at least one slot of the other pair of slots and between the slots of the other pair of slots; and the mounting means for a first set of heater elements acting through the one pair of slots and the mounting means for a second set of heater elements acting through the other pair of slots with the end portions of heater elements in the two columns of heater elements alternately along the pairs of slots.

* * * * *